US007255517B2

(12) United States Patent
Basak et al.

(10) Patent No.: US 7,255,517 B2
(45) Date of Patent: Aug. 14, 2007

(54) BALLASTING OFFSHORE PLATFORM WITH BUOY ASSISTANCE

(75) Inventors: Jayant Basak, Houston, TX (US); Jeremy Denman, Spring, TX (US); Charles Cinotto, New Braunfels, TX (US); Chandra Nair, Houston, TX (US)

(73) Assignee: Deepwater Marine Technology L.L.C., George Town (KY)

( * ) Notice: Subject to any disclaimer, the term of this patent is extended or adjusted under 35 U.S.C. 154(b) by 0 days.

(21) Appl. No.: 11/140,332

(22) Filed: May 27, 2005
(Under 37 CFR 1.47)

(65) Prior Publication Data

US 2005/0281624 A1 Dec. 22, 2005

Related U.S. Application Data

(60) Provisional application No. 60/575,476, filed on May 28, 2004.

(51) Int. Cl.
*E02D 23/02* (2006.01)

(52) U.S. Cl. ..... 405/205; 405/224

(58) Field of Classification Search ..... 405/195.1, 405/203, 208
See application file for complete search history.

(56) References Cited

U.S. PATENT DOCUMENTS

| | | | | |
|---|---|---|---|---|
| 5,330,293 | A * | 7/1994 | White et al. | 405/211 |
| 5,609,442 | A * | 3/1997 | Horton | 405/205 |
| 6,371,697 | B2 | 4/2002 | Huang et al. | 405/224.2 |
| 6,503,023 | B2 | 1/2003 | Huang et al. | 405/206 |
| 6,652,192 | B1 * | 11/2003 | Xu et al. | 405/195.1 |
| 6,786,679 | B2 | 9/2004 | Huang et al. | 405/209 |
| 6,869,251 | B2 | 3/2005 | Zou et al. | 405/205 |
| 2004/0190999 | A1 | 9/2004 | Wybro et al. | 405/203 |

* cited by examiner

*Primary Examiner*—Tara L. Mayo
(74) *Attorney, Agent, or Firm*—Bracewell & Giuliani LLP

(57) ABSTRACT

A method for deploying a floating platform includes storing buoys on a hull of the platform. Tension devices are mounted to the hull, each being connected by a line to one of the buoys. The operator tows the hull to a ballast down site while the buoys are stored on the hull. While adding ballast to the hull, the operator feeds out the lines from the tension devices at a selected tension. The hull moves downward in the water while the buoys float at the surface to maintain stability during the ballasting. The buoys are detached from the lines after the hull is ballasted to a desired depth.

18 Claims, 2 Drawing Sheets

BALLASTING OFFSHORE PLATFORM WITH BUOY ASSISTANCE

This invention claims the benefit of provisional application Ser. No. 60/575,476, filed May 28, 2004.

FIELD OF THE INVENTION

This invention relates in general to floating offshore oil and gas platforms, and in particular to a method for ballasting platform while using buoys for assistance.

BACKGROUND OF THE INVENTION

Offshore floating platforms are utilized for hydrocarbon extraction and processing. The platforms have tanks that provide the necessary floatation. Water is pumped into at least some of the tanks to provide ballast for positioning the platform at a desired draft. A certain amount of draft may be necessary to prevent capsizing under the effects of wind and waves during storms. The desired draft might be needed both for towing to a well site as well as while stationed at the well site.

Typically, when a platform is being ballasted to the desired draft, it will undergo a region of instability between the initial draft and the desired draft. While in the region of instability, the righting moment of the platform is insufficient to keep the platform upright if it heels excessively. The ballasting must be carefully controlled while in the region of instability to avoid a catastrophe.

Some platforms have a very deep draft, which may be hundreds of feet. Typically, these platforms have a single cylindrical column and may be called "spars" or "deep draft caisson vessels". Normally, a single column hull is towed to the well site while in a horizontal position, then ballasted to an upright position. These vessels also undergo a region of instability, thus upending the structure at the well site has associated risks. After being upended and ballasted to the desired depth, a catenary mooring system is used to hold the vessel at the well site. A large barge and crane at the well site lifts a deck structure onto the spar after it is at the desired draft and moored.

U.S. Pat. No. 6,371,697 discloses a single column floater that has a larger diameter lower section to provide stability and buoyancy. This patent discloses towing the single column floater to the well site in an upright position. The vessel is towed to the well site at a towing draft, then ballasted at the well site to a desired draft. A catenary mooring system holds the single column floater on station. The deck and structure may be placed on the single column floater while at the dockside, avoiding a need for a barge and crane at the well site. Even though ballasting occurs while the vessel is upright, instability can still exist during the process.

One proposed method to provide stability during ballasting deals specifically with tension leg platforms ("TLP"). A TLP is not moored with a catenary mooring system, rather it is held on station by tendons under tension. The tendons comprise hollow, buoyant strings of pipe extending vertically upward from the sea floor to the platform. Normally the TLP is towed to the well site at a first draft, then ballasted to a second draft. The operator connects the tendons to the TLP and removes ballast to place the tendons in tension. U.S. patent application Publication 2004/0190999 discloses connecting pull-down lines between upper ends of the tendons and pull down devices on the platform. The operator applies tension to the pull-down lines while ballasting to avoid instability. When the tops of the tendons pass through the top terminations on the platform, the operator connects the tendons to the platform, removes the pull-down lines, and deballasts until the desired tension in the tendons is reached.

SUMMARY OF THE INVENTION

In this invention, at least one tension device is mounted to a hull of the platform. A line extends from the tension device to a buoy. While adding ballast to the hull, the operator feeds out the line from the tension device and maintains a desired tension in the line. The buoy provides stability to the hull as the hull passes through a zone of instability while being ballasted. After passing through the zone of instability, the operator may detach the buoy from the tension device.

In one embodiment of the invention, while at the dockside, a number of the buoys are stored on supports attached to the perimeter of the hull. The operator tows the hull to a ballast down site while the buoys are located on the supports. The operator ballasts the hull to a safe towing draft at the ballast down site, using the buoys to provide stability as it passes through the region of instability. The operator removes the buoys and tows the hull at the towing draft to a well site. At the well site, the operator adds more ballast to reach a desired operating draft. The buoys are not required while at the towing draft or while adding more draft at the well site. The operator moors the hull with a conventional system.

In one embodiment, the hull is a single column type, and catenary mooring is used. Alternately, the hull may be a tension leg platform using pontoons and columns. Tendons are used to anchor the hull.

DETAILED DESCRIPTION OF THE INVENTION

Figure 1:
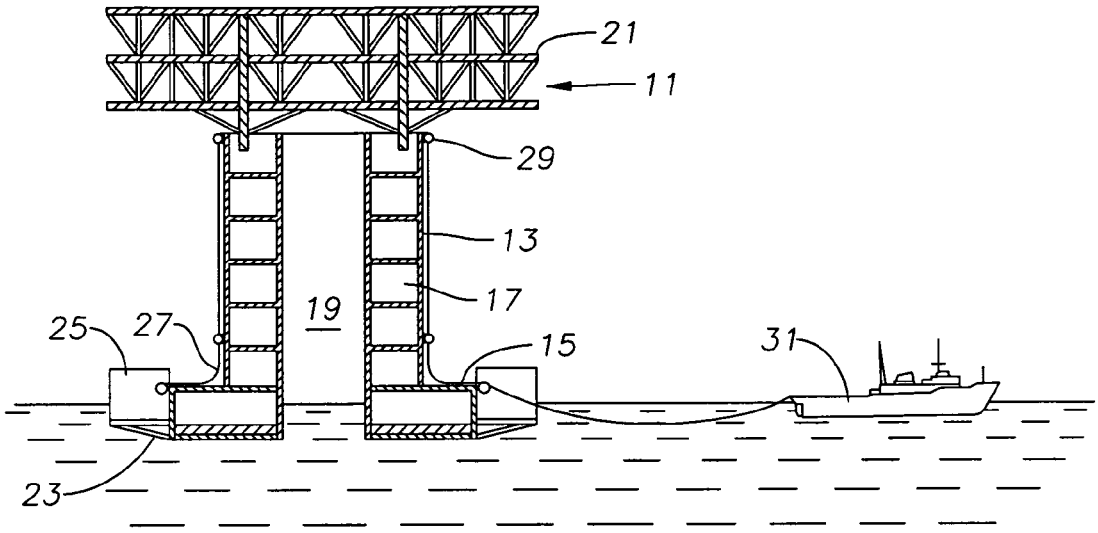
FIG. 1 is a schematic side view illustrating a platform being towed from dockside to an initial staging site for ballasting.

Referring to FIG. 1, platform 11 is a floating vessel that is used particularly for oil and gas well drilling and production. In this embodiment, platform 11 has a single elongated hull or column 13 as shown in U.S. Pat. No. 6,503,023, but it could have a plurality of columns and be of different designs, such as a tension leg platform. Column 13 has a cylindrical base 15 of a larger diameter than column 13. Column 13 and base 15 have a plurality of compartments 17 that may be sealed from each other for ballasting platform 11 to a desired depth. A central passage 19 extends axially within column 13. Production and/or drilling risers (not shown) are typically supported by platform 11 at the well site and pass through central passage 19. If platform 11 is serving as a tender vessel to a production and drilling platform, typically the lower end of central passage 19 would be closed. One or more decks 21 are mounted to column 13 of platform 11 for supporting drilling and/or production equipment.

Platform 11 has a plurality of supports or outriggers 23 spaced around its perimeter. A buoy 25 is shown in FIG. 1 temporarily resting on each outrigger 23. Buoy 25 is a buoyant, airtight member that may be cylindrical, spherical or other shapes. The number of buoys 25 depends upon their size and the size of platform 11. Buoy 25 could comprise a single tank that surrounds at least a portion of column 13 or it could be made up of segments that releasably attach to each other to form an annular shape, as described in U.S. Pat. No. 6,786,679.

Figure 2:
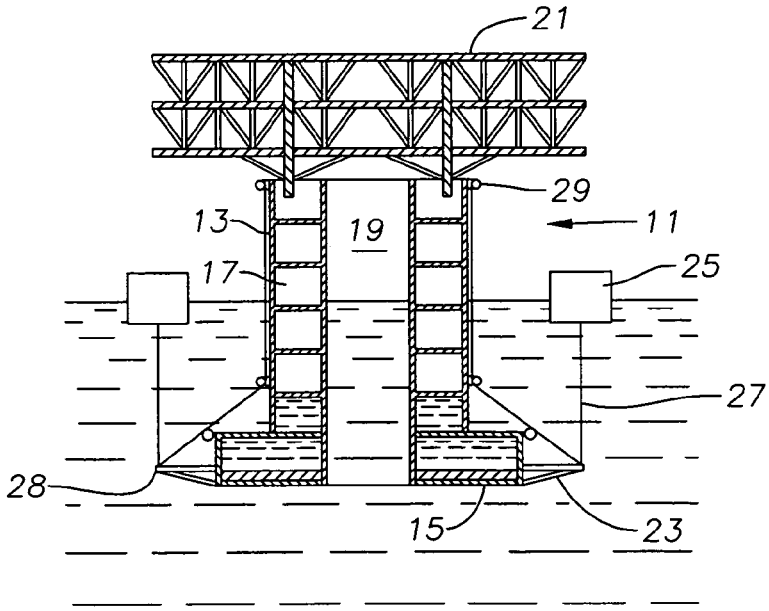
FIG. 2 is a schematic side view showing the platform of FIG. 1 being ballasted at the staging site to a desired towing draft.
Figure 3:
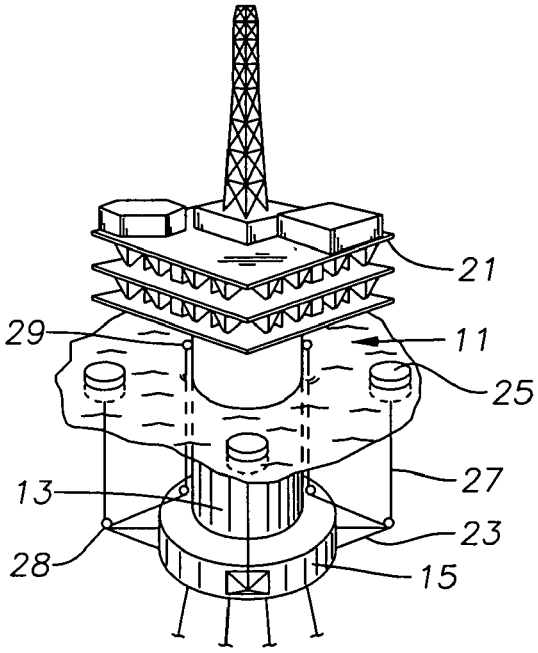
FIG. 3 is a perspective view of the platform of FIG. 1 being ballasted at the staging site to the desired towing draft.
Figure 4:
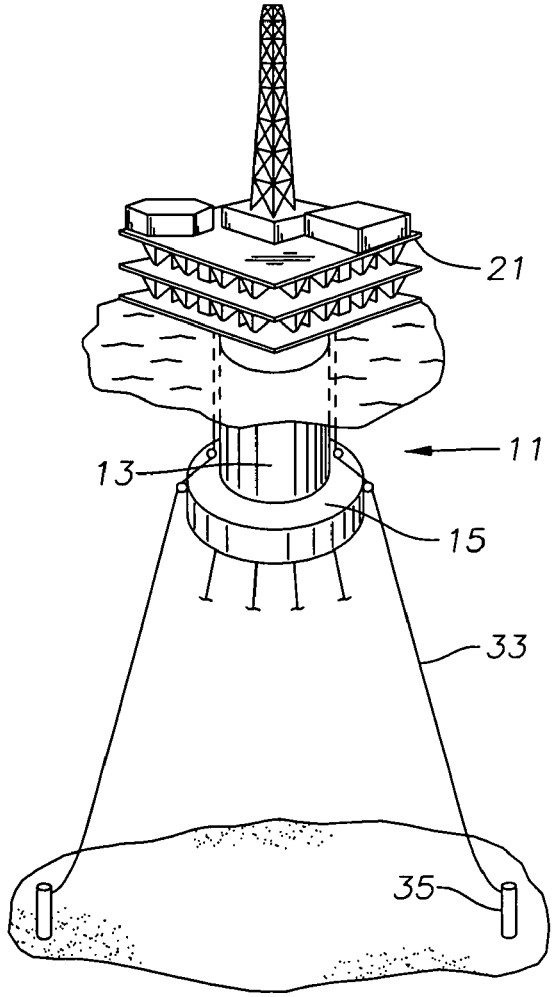
FIG. 4 is a perspective view of the platform of FIG. 3, shown deployed at a well site at an operational draft.

Each buoy 25 is attached to a line 27 that leads through a lower line guide 28 on outrigger 23 (FIGS. 2, 3) to a lifting or tension device 29. Line 27 may comprise chain, cable or rope. Tension device 29 may be a winch, chain jack, strain jack, rotating block or other means of applying tension to lines 27. Tension devices 29 are preferably located at the top of column 13.

During manufacturing, deck 21 may be installed while platform 11 is located beside a dock, or it could be installed at an offshore site. Platform 11 is designed to be towed to a well site while in a vertical orientation. In the event of storms, platform 11 has a towing draft deeper than the dockside draft to avoid heeling excessively in high winds. Normally, the water alongside the dock is not deep enough to ballast platform 11 to its safe towing draft. Depending upon the size of platform 11, the water may need to be 200 to 500 feet in depth to accommodate the towing draft.

In this invention, while platform 11 is at a first or dockside draft, a tug 31 will tow platform 11 out to a water depth that is sufficient for it to be ballasted to its safe towing draft. Buoys 25 will preferably be stored on supports 23 while being towed from the dock side. Supports 23 are located near the lower end of column 13. Preferably, buoys 25 are partially submerged while column 13 is being towed to the staging site. Also, buoys 25 will be temporarily fastened to supports 23 by fasteners (not shown) that are readily releasable. The fasteners could be a variety of devices, such as straps or latches.

Once at the staging site, the operator releases the fasteners that hold buoys 25 on supports 23 and begins admitting ballast water to compartments 17. As column 11 lowers in the water, the operator feeds out lines 27 with tension devices 29. Buoys 25 lift upward from outriggers 23 as vessel 11 moves downward. The operator determines a tension that is desired for each of the lines 27 and controls the rate of addition of water ballast and the rate at which tension devices 29 feed out line 27 in order to maintain that desired tension. As platform 11 moves downward, buoys 25 provide additional stability necessary for platform 11 by maintaining a positive righting arm through its region of instability. Once platform 11 is at a sufficient draft to be stable, buoys 25 may be removed. Tug 31 tows platform 11 to a desired well site at its safe towing draft without buoys 25.

When at the well site, the operator normally ballasts platform 11 further to a desired installation draft. In this embodiment, catenary mooring lines 33 are attached to anchors or pilings 35 to maintain platform 11 at the desired location. With a catenary mooring system, the lines extend in long gradual curves to anchors or pilings imbedded in the sea floor outside the perimeter of vessel 11. Other types of platforms may require tendons to be placed under tension rather than catenary lines 33.

The invention has significant advantages. The buoys and tension devices provide stability when ballasting the vessel to towing and installation drafts. The buoys are readily removable after installation and may be re-used.

While the invention has been shown in only one of its forms, it should be apparent to those skilled in the art that it is not so limited but is susceptible to various changes without departing from the scope of the invention.

The invention claimed is:

1. A method for deploying a floating platform, comprising:

(a) mounting to a hull of the platform a tension device for feeding out and taking up a line;

(b) attaching the line from the tension device to a buoy; then (c) adding ballast to the hull, causing the hull to move downward in the water relative to the buoy and the line to extend generally upward from a point on the hull to the buoy;

(d) simultaneously with step (c), actuating the tension device to feed out the line from the tension device and applying an upward force on the hull by maintain a desired tension in the line to provide stability to the hull as it is being ballasted; and after reaching a desired draft in step (d), detaching the buoy from the tension device.

2. The method according to claim 1, further comprising:

after reaching a desired deployment draft in step (d), anchoring the hull to the sea floor.

3. The method according to claim 1, further comprising:

after reaching a desired deployment draft in step (d), anchoring the hull with a catenary mooring system.

4. The method according to claim 1, further comprising:

before step (c), towing the hull at a first draft to a site for performing step (d); and supporting the buoy on the platform while towing the hull at the first draft.

5. The method according to claim 4, wherein the buoy is partially submerged while towing the hull at the first draft.

6. A method for deploying a floating platform, comprising:

(a) mounting to a hull of the platform a tension device for feeding out and taking up a line;

(b) attaching the line from the tension device to a buoy; then (c) adding ballast to the hull, causing the hull to move downward in the water relative to the buoy and the line to extend generally upward from a point on the hull to the buoy;

(d) simultaneously with step (c), actuating the tension device to feed out the line from the tension device and applying an upward force on the hull by maintain a desired tension in the line to provide stability to the hull as it is being ballasted; and after reaching a selected towing draft in step (d), detaching the buoy from the tension device, then towing the hull at the towing draft without the buoy to a deployment location; then ballasting the hull without the buoy from the towing draft to a desired deployment draft.

7. A method for deploying a floating platform, comprising:

(a) mounting to a hull of the platform a tension device for feeding out and taking up a line;

(b) attaching the line from the tension device to a buoy; then (c) adding ballast to the hull, causing the hull to move downward in the water relative to the buoy and the line to extend generally upward from a point on the hull to the buoy;

(d) simultaneously with step (c), actuating the tension device to feed out the line from the tension device and applying an upward force on the hull by maintain a desired tension in the line to provide stability to the hull as it is being ballasted; and wherein the hull has at least one column, step (a) comprises mounting the tension device on an upper portion of the column, and step (b) comprises extending the line downward from the tension device through a line guide on a lower portion of the column and to the buoy.

8. A method for deploying a floating platform, comprising:

(a) storing a plurality of buoys on a hull of the platform;

(b) mounting to the hull a plurality of tension devices for feeding out and taking up line;

(c) towing the hull to a site while the buoys are stored on the hull;

(d) connecting the tension devices to the buoys via lines that extend through lower line guides on lower portions of the hull;

(e) adding ballast to the hull, which submerges the lower line guides, and operating the tension devices to feed out the lines from the lower line guides while maintaining a selected tension in the lines, causing the hull to move downward in the water while the buoys float at the surface and exert upward forces on the hull via the lines to maintain stability during ballasting; then (f) detaching the buoys from the lines; and (g) anchoring the hull to the sea floor.

9. The method according to claim 8, further comprising:

after step (f) and before step (g), towing the hull from the site to a different location for performing step (g).

10. The method according to claim 8, wherein while performing step (c), the buoys are partially submerged.

11. The method according to claim 8, wherein step (g) is performed using a catenary mooring system.

12. The method according to claim 8, wherein the hull comprises a single column, the tension devices are mounted on an upper portion of the column, and the buoys are stored on a lower portion of the hull during step (c).

13. The method according to claim 8, wherein step (a) comprises mounting a plurality of supports to an outer perimeter of the hull, and releasably securing the buoys to the supports.

14. The method according to claim 8 wherein step (e) comprises ballasting the hull to a desired towing draft, and wherein the method further comprises:

after reaching the selected towing draft, detaching the buoys from the tension devices, then towing the hull at the towing draft without the buoys to a deployment location; then ballasting the hull further without the buoys until reaching a desired deployment draft; then performing step (g).

15. An offshore platform, comprising:

a buoyant hull having at least one compartment for receiving water ballast;

a plurality of lines;

a plurality of tension devices for taking up and feeding out the lines mounted to the hull;

a plurality of line guides, each mounted to a lower portion of the hull;

a plurality of buoys, each of the lines extending from one of the tension devices through one of the line guides and upward to one of the buoys;

wherein as ballast is added to the hull, the hull moves downward relative to the buoys while the tension devices feed out the lines and the buoys exert upward forces on the hull;

the tension devices maintain a desired tension in the lines due to the buoyancy of the buoys to enhance stability of the hull while being ballasted;

a plurality of supports mounted to and extending from the periphery of the hull; and wherein each of the buoys is releasably mounted to one of the supports.

16. The platform according to claim 15, wherein the supports and at least some of the line guides are located near a bottom of the hull and the tension devices are located near a top of the hull.

17. The platform according to claim 15, wherein:

the hull comprises at least one column.

18. The platform according to claim 15, wherein:

the hull comprises a single cylindrical column;

the supports are spaced around the column;

the tension devices are located adjacent an upper end of the column; and at least some of the line guides are located on a lower portion of the column.

* * * * *